US009339092B2

(12) United States Patent
Vaitl

(10) Patent No.: US 9,339,092 B2
(45) Date of Patent: May 17, 2016

(54) INFLATABLE UMBRELLA

(75) Inventor: Rolf Vaitl, Munich (DE)

(73) Assignee: RB Holding GmbH, Oldenburg (DE)

( * ) Notice: Subject to any disclaimer, the term of this patent is extended or adjusted under 35 U.S.C. 154(b) by 50 days.

(21) Appl. No.: 13/812,399

(22) PCT Filed: Jul. 25, 2011

(86) PCT No.: PCT/DE2011/001517

§ 371 (c)(1),
(2), (4) Date: Feb. 28, 2013

(87) PCT Pub. No.: WO2012/062245

PCT Pub. Date: May 18, 2012

(65) Prior Publication Data

US 2013/0152985 A1 Jun. 20, 2013

(30) Foreign Application Priority Data

Jul. 26, 2010 (DE) ..... 10 2010 032 210

(51) Int. Cl.
*A45B 19/02* (2006.01)
*A45B 25/16* (2006.01)

(52) U.S. Cl.
CPC ..... *A45B 19/02* (2013.01); *A45B 25/165* (2013.01)

(58) Field of Classification Search
CPC ..... A45B 19/02; A45B 25/165
USPC ..... 135/15.1, 19.5, 20.2
See application file for complete search history.

(56) References Cited

U.S. PATENT DOCUMENTS

| | | | | | |
|---|---|---|---|---|---|
| 2,753,878 | A | * | 7/1956 | Halberstam | 135/20.2 |
| 3,538,928 | A | * | 11/1970 | Szilagyi et al. | 135/20.2 |
| 4,068,675 | A | * | 1/1978 | Pappanikolaou | 135/20.2 |
| 4,370,994 | A | * | 2/1983 | Pittman | 135/20.2 |
| 6,354,314 | B1 | * | 3/2002 | Iurincich | 135/20.2 |
| 2004/0099296 | A1 | * | 5/2004 | Chang | 135/20.2 |
| 2009/0301532 | A1 | * | 12/2009 | Vaitl | 135/20.2 |

FOREIGN PATENT DOCUMENTS

| | | | | |
|---|---|---|---|---|
| CA | 1109765 | | * | 9/1981 |
| CN | 86204103 | U | | 5/1987 |
| CN | 101420879 | A | | 4/2009 |
| DE | 1684930 | U | | 10/1954 |
| DE | 29922062 | U1 | * | 2/2000 |
| DE | 102006009262 | A1 | | 9/2007 |
| DE | 102012107179 | A1 | * | 2/2014 |
| EP | 0003661 | A1 | | 8/1979 |
| FR | 1464750 | A | | 1/1967 |
| FR | 1586011 | | | 2/1970 |
| FR | 2679423 | | * | 1/1993 |
| JP | S48-10659 | | | 6/1948 |

(Continued)

*Primary Examiner* — David R Dunn
*Assistant Examiner* — Danielle Jackson

(57) ABSTRACT

An inflatable umbrella has an inflatable covering made from a flexible material. In an inflated state, said covering forms at least the following elements: a central holding element, at least three umbrella strut elements extending away from the central holding element, and at least one umbrella surface element stretched out by the umbrella strut elements. In this case, the central holding element and each umbrella strut element are supported against each other at the respective contact point thereof. In the inflated state, the umbrella has greater stability and resistance to external forces in comparison to previously known inflatable umbrellas.

15 Claims, 9 Drawing Sheets

(56) References Cited

FOREIGN PATENT DOCUMENTS

| | | | |
|---|---|---|---|
| JP | S4845852 | U | 6/1973 |
| JP | S49-25645 | | 7/1974 |
| JP | S50154165 | | 12/1975 |
| JP | 61-40920 | | 3/1986 |
| JP | H02124016 | | 10/1990 |
| JP | H043018 | U | 1/1992 |
| JP | H0481513 | | 7/1992 |
| JP | 06133812 | * | 5/1994 |
| JP | 2010017381 | | 1/2010 |
| TW | M251496 | U | 12/2004 |
| WO | 9938412 | A2 | 8/1999 |

* cited by examiner

INFLATABLE UMBRELLA

FIELD OF THE INVENTION

The present invention relates to an inflatable umbrella.

BACKGROUND OF THE INVENTION

Conventional umbrellas and in particular rain umbrellas are devices that are in general relatively unwieldy and are often awkward to use. They are particularly inconvenient when not in use, i.e. when sunny or rainy weather has either not yet begun or has already stopped. Particularly due to the fact that they are not easily portable, they are often left behind or forgotten. As a result, they are also often not brought along, for example when sun or rain is not likely. If, for example, rain does then occur contrary to expectations, people are largely unprotected or attempt to protect themselves from the rain in a makeshift way by covering their heads with objects such as a purse or items of clothing such as a jacket or the like. This takes its toll on these objects and items of clothing. In addition, such makeshift solutions only afford insufficient protection.

This basic problem has been known for a long time, leading to the development of partially collapsible umbrellas, which have also been known for a long time and which in the closed state take up significantly less space than conventional umbrellas, but are still relatively large and unwieldy. It is in fact possible for them to fit into a purse or the like that is carried. However, when doing so, the considerable weight of these umbrellas makes their presence annoying. Also, when no purse is to be carried, there is usually no practical way to carry these umbrellas.

The above-described problem is becoming even more critical due to the fact that the change in worldwide climate conditions could result in the fact that local weather conditions change more quickly from one extreme to another. As a result, weather conditions and in particular the probability of rain, can change significantly within a few hours or even a shorter time frame. It is therefore necessary when out of doors to be able to protect oneself from the possibility of a sudden onset of rain at any moment.

It is clear from the documents of the prior art that one direction toward which improvements in umbrella usability strive is to reduce their awkwardness, i.e. the number and or size of awkward parts in umbrellas. The awkwardness of conventional umbrellas is in particular due to the handle, the central holding rod, and the radial struts that stretch open the umbrella fabric. The aim of modifications is therefore necessarily to replace these elements with other elements that are roughly functionally equivalent.

A large number of prior publications have therefore already proposed embodying an umbrella in the form of an inflatable umbrella, which is inflated for use and otherwise, can be practically transported in the collapsed state. A gas-filled envelope replaces the umbrella fabric that is usually stretched open by metallic structures, thus providing the necessary rigidity.

The publication DE 10 2006 009 262 A1 describes an umbrella that has an inflatable envelope that assumes the shape of a dome when inflated. The dome can be held over the head of a user for protection. On the inside of the inflatable envelope, a chemical reaction can produce a gaseous substance that serves to inflate the envelope.

In principle, a very high pressure in an inflatable envelope can also achieve a very high rigidity of the envelope. Since the inflatable envelope cannot be very thick so that it is not too heavy and does not take up too much space when in a collapsed state, however, it is not possible for the pressure to be limitlessly high. Consequently, in the inflatable umbrellas that have been disclosed up to now, the problem has been that in an inflated state, they do not have the required stability to resist powerful, externally acting forces such as forces generated by heavy wind or rain.

The object of the present invention is to create an improved inflatable umbrella that is more stable in an inflated state and is better able to resist external forces than previously known umbrellas.

SUMMARY OF THE INVENTION

In a first embodiment, an umbrella has an inflatable envelope composed of a flexible material. In an inflated state, this envelope is comprised of at least the following elements: a central holding element, at least three umbrella strut elements extending away from the central holding element, and at least one umbrella surface element stretched open by the umbrella strut elements. The central holding element and each umbrella strut element are supported against each other at their respective contact point.

The support of the central holding element and the umbrella strut elements against one another on the one hand centers, vertically aligns, and stabilizes the central holding element. On the other hand, it produces a stable alignment of the umbrella strut elements. The statics are automatically produced by self-locking structures. On the whole, this achieves greater stability and resistance to external forces such as wind forces or forces generated by the impact of rain.

In a second embodiment, two respective adjoining umbrella strut elements are supported against each other at their respective contact point. The additional support of umbrella strut elements against one another can achieve an additional stabilization of the umbrella and in particular, an increased resistance to laterally acting forces such as wind forces.

In a third embodiment, an imaginary center axis of an umbrella strut element intersects with an imaginary center axis of an umbrella strut element adjoining it on a first side, outside of an imaginary center axis of the central holding element. Consequently, each umbrella strut element extends next to and laterally offset from the central holding element. The ends of the umbrella strut elements oriented toward the central holding element are thus grouped around the central holding element in a way that centers, vertically aligns, and stabilizes it, thus on the whole achieving a greater stability of the umbrella.

In a fourth embodiment, an imaginary center axis of an umbrella strut element and an imaginary center axis of an umbrella strut element adjoining it on a first side are askew to each other and a span of extremely short length between the imaginary center axis of the umbrella strut element and the imaginary center axis of the umbrella strut element adjoining it on the first side does not intersect with an imaginary center axis of the central holding element. Consequently, each umbrella strut element extends next to and laterally offset from the central holding element. The ends of the umbrella strut elements oriented toward the central holding element are thus grouped around the central holding element in a way that centers, vertically aligns, and stabilizes it, thus on the whole achieving a greater stability of the umbrella.

In a fifth embodiment, an umbrella strut element and an umbrella strut element adjoining it on a first side are supported against each other at a contact point, which is located at an end of the umbrella strut element oriented toward the umbrella strut element adjoining it on the first side while the umbrella strut element and an umbrella strut element adjoining it on a second side are supported against each other at a contact point, which is located at an end of the umbrella strut element adjoining the second side oriented toward the umbrella strut element. Consequently, the umbrella strut elements are supported against each other so that they are aligned in a stable fashion. An increased resistance to laterally acting forces is achieved.

In a sixth embodiment, a cross-sectional area of the central holding element increases in a penultimate section of the central holding element before the umbrella strut elements and decreases in a final section of the central holding element before the umbrella strut elements and a cross-sectional area of each respective umbrella strut element increases in a penultimate section of the respective umbrella strut element before the central holding element and decreases in a final section of the umbrella strut element before the central holding element. In the regions with the enlarged cross-sectional area, the central holding element and the umbrella strut elements are more rigid and stable.

In a seventh embodiment, an end of the central holding element oriented toward the umbrella strut elements is embodied as essentially pyramid-shaped, a cross-sectional area of the central holding element forms a base of the pyramid, and the respective contact point of the central holding element and the respective umbrella strut element is situated on a respective side surface of the pyramid. As a result, the end of the central holding element oriented toward the umbrella strut elements is embodied with a number of oblique surfaces that corresponds to the number of umbrella strut elements at which the central holding element and the umbrella strut elements rest against one another in a stable fashion.

In an eighth embodiment, an end of each respective umbrella strut element oriented toward the central holding element is embodied as essentially pyramid-shaped; a cross-sectional area of the umbrella strut element forms a base of the pyramid, the respective contact point of the respective umbrella strut element and the central holding element is situated on a first side surface of the pyramid, a contact point of the respective umbrella strut element and an umbrella strut element adjoining it on a first side is situated on a second side surface of the pyramid, and a contact point of the respective umbrella strut element and an umbrella strut element adjoining it on a second side is situated on a third side surface of the pyramid. As a result, at the end of a respective umbrella strut element oriented toward the central holding element, there are a number of oblique surfaces that on the one hand, serve to support the umbrella strut element and the central holding element against each other and on the other hand, serve to support the umbrella strut element and the adjoining umbrella strut elements against each other. On the whole, this achieves a high stability of the umbrella.

In a ninth embodiment, the umbrella has a compressible material and a valve and through compression of the compressible material, a gaseous substance for the inflation can be aspirated via the valve and conveyed into the interior of the inflatable envelope. By repeatedly compressing the compressible material, the umbrella can be quickly inflated with the gaseous substance. If after being manufactured, the umbrella is collapsed down under a negative pressure or vacuum, the volume of the compressible material can be minimized, thus achieving a small size of the collapsed umbrella.

In a tenth embodiment based on the ninth embodiment, the compressible material is enclosed by an envelope composed of a flexible material whose one end is connected to the valve and whose other end forms an inner tube valve; the gaseous substance can be conveyed into the interior of the inflatable envelope via the inner tube valve. The inner tube valve is controlled by a pressure on the interior of the umbrella or inflatable envelope, thus making it possible to pump up the umbrella in cooperation with the valve.

In an eleventh embodiment based on the ninth embodiment, the compressible material is a material with a foam structure that can be successively compressed by an increasing pressure in the inflatable envelope so that a pumping power that can be achieved with the compressible material decreases and excessive pressure does not build up in the inflatable envelope. The interior pressure being built up achieves a desired reduction in the pumping power, which automatically prevents a maximum permissible pressure from being exceeded.

In a twelfth embodiment based on the ninth embodiment, the compressible material is situated in a handle of the central holding element with a changed cross-sectional area and can be compressed through manual pumping actions executed by a user. This makes optimal use of the shape of the hollow of a hand and achieves a high pumping power.

In a thirteenth embodiment, at least two chemical substances are situated separately from each other in the inflatable envelope; when they are brought into contact with each other, a chemical reaction can be triggered, by means of which a gaseous substance can be generated for the inflation. This permits an automatic inflation through simple means.

In a fourteenth embodiment, the umbrella has a telescoping handle and before an inflation, the inflatable envelope is contained inside the telescoping handle and the inflation can be produced by pumping actions of the telescoping handle. The packing of the inflatable envelope in the telescoping handle before an inflation can reduce the amount of space taken up by the umbrella when not in use.

In a fifteenth embodiment, the inflatable envelope has at least one valve and can be inflated and/or deflated via the valve. A user can inflate the umbrella by mouth at any time and can also empty it again.

Exemplary embodiments of the present invention are described by way of example below with reference to the drawings.

DETAILED DESCRIPTION OF THE PREFERRED EMBODIMENTS

Figure 1:
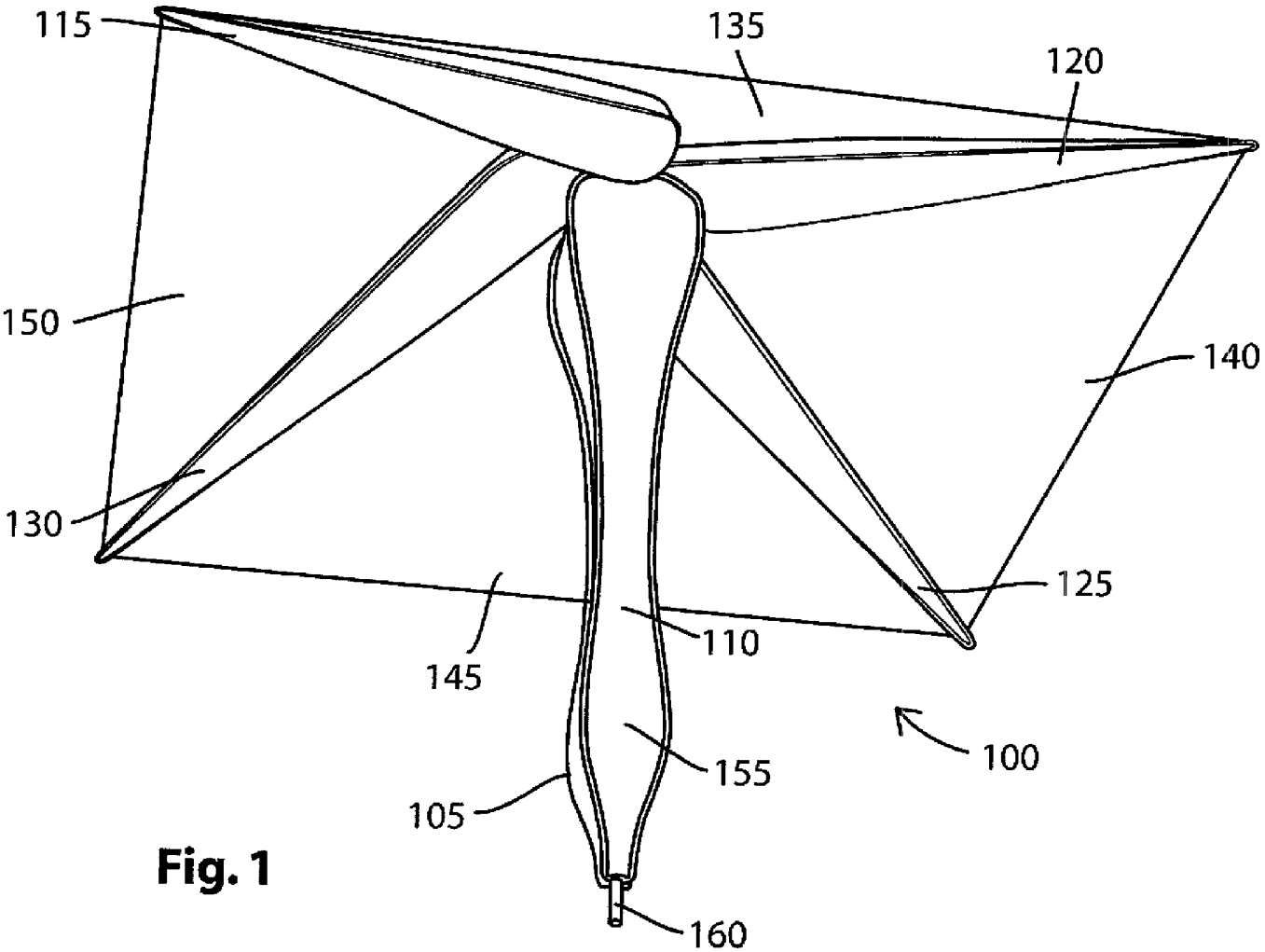
FIG. 1 is a perspective view (obliquely from below) of an umbrella according to a first exemplary embodiment in an inflated state.

FIG. 1 is a perspective view (obliquely from below) of an umbrella 100 according to a first exemplary embodiment in an inflated state. The umbrella has an inflatable envelope 105. This envelope is composed of a flexible material, e.g. a suitable plastic material such as polypropylene, polyethylene terephthalate (PET), or the like. Alternatively, a suitable film material, in particular balloon film, can be used. For example, this material can be Heptax or Mylar®, a biaxially oriented polyester film ("boPET") made of PET. Mylar® features a high tensile strength, chemical, mechanical, and thermal stability, as well as transparency. It is a good electrical insulator and has a low water absorption. These properties are advantageous for the umbrella 100 according to the first exemplary embodiment.

In the umbrella 100 according to the first exemplary embodiment, in the inflated state, the inflatable envelope 105 forms a central holding element 110, four umbrella strut elements 115, 120, 125, 130 extending away from the central holding element 110 and four umbrella surface elements 135, 140, 145, 150 spread open by the umbrella strut elements 115, 120, 125, 130. FIG. 1 shows how the umbrella strut elements 115, 120, 125, 130 are grouped around the central holding element 110 and spread open the umbrella surface elements 135, 140, 145, 150. FIG. 1 also shows that the umbrella strut elements 115, 120, 125, 130 are supported against the central holding element 110 and vice versa. This is explained in detail below.

Figure 2:
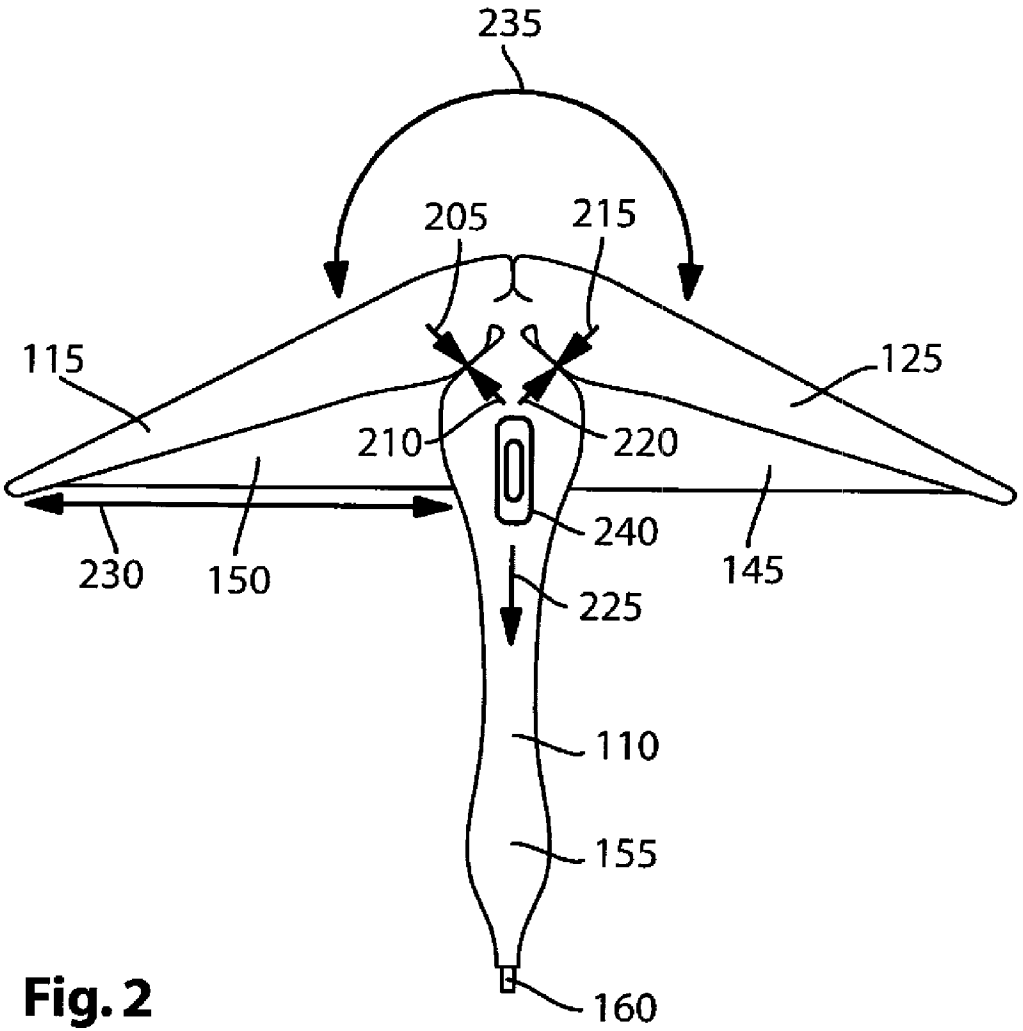
FIG. 2 is a cross-sectional view of the umbrella according to the first exemplary embodiment in the inflated state.

As shown in FIG. 1 and also in FIG. 2, the central holding element 110 has a changed cross-sectional area in a region before an end of the central holding element 110 oriented away from the umbrella strut elements 115, 120, 125, 130. To be more precise, an ergonomically shaped handle 155 is provided in this region, which is designed for a user's hand and permits the user to comfortably hold the umbrella 100. The larger cross-sectional area also increases the rigidity and stability of the central holding element 110 in the region of the handle 155. A first valve 160 is situated at a lower end of the handle 155.

FIG. 2 shows a cross-sectional view of the umbrella 100 according to the first exemplary embodiment in the inflated state. The drawing shows that the central holding element 110 and a respective umbrella strut element 115, 125 are supported against each other at their respective contact point. The central holding element 110 functions as a pressure element and the respective umbrella strut element 115, 125 functions as a counterpart pressure element and vice versa. FIG. 2 shows this for the central holding element 110 and the cross-sectionally depicted umbrella strut element 115 by means of a pair of arrows 205, 210 pointing at each other and shows this for the central holding element 110 and the cross-sectionally depicted umbrella strut element 125 by means of a pair of arrows 215, 220 pointing at each other.

In other words, the central holding element 110 and each of the umbrella strut elements 115, 120, 125, 130 are supported against each other. This achieves a vertical and stable alignment of the central holding element 110 and a stable alignment of the umbrella strut elements 115, 120, 125, 130. In other words, the statics are automatically produced by self-locking structures.

The vertical alignment of the central holding element 110 is indicated by an arrow 225 in FIG. 2. The umbrella strut elements 115, 120, 125, 130 spread open the umbrella surface elements 135, 140, 145, 150. Each pair of adjoining umbrella strut elements spreads open an interposed umbrella surface element or the edges thereof. In FIG. 2, an arrow 230 with two heads indicates this for the umbrella strut element 115 situated on the left side and for an adjoining umbrella strut element 130, which is not visible in the cross-sectional view due to its position behind the central holding element 110. On the whole, the inflation of the umbrella produces a spreading force, which is symbolized in FIG. 2 by an arrow 235 with two heads.

The inflatable envelope 105 of the umbrella 100 shown in FIG. 2 is equipped with the first valve 160 and a second valve 240. It can be inflated via the first valve 160 by mouth or by means of an external inflating device and can be deflated via the second valve 240. In this case, the first valve 160 can be a check valve. It is also possible, however, to use the same valve 160 both for inflating and deflating the inflatable envelope 105. For example, a simple mouthpiece can be provided with a closure. In addition, alternative inflating systems can be used, some of which are described further below.

Figure 3:
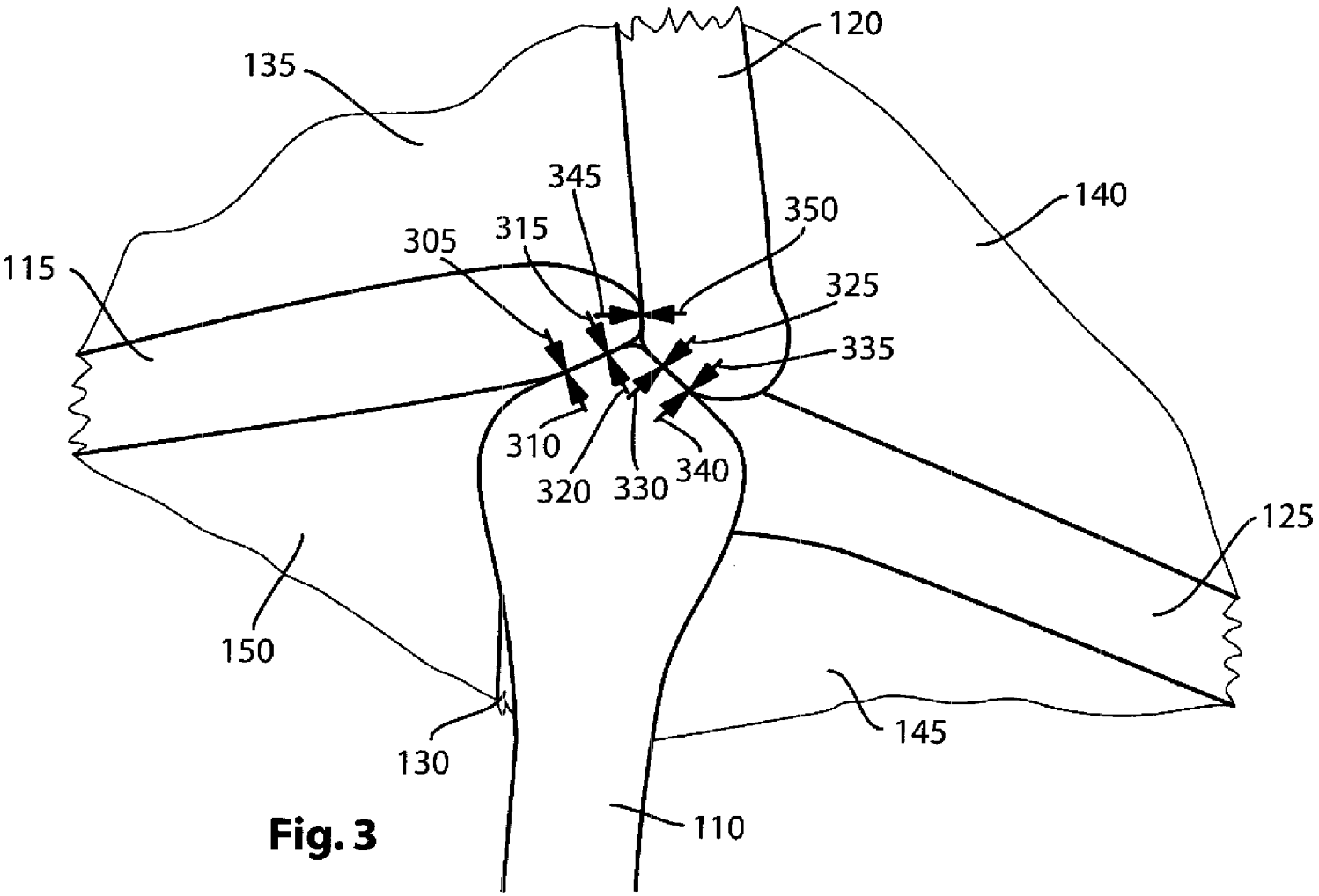
FIG. 3 is an enlarged view (obliquely from below) of a central region of the umbrella according to the first exemplary embodiment in the inflated state.

FIG. 3 is an enlarged view (obliquely from below) of a central region of the umbrella 100 according to the first exemplary embodiment in the inflated state. The support of the central holding element 110 and the umbrella strut element 115 against each other at their contact point is illustrated in the drawing by means of two pairs of arrows 305, 310 and 315, 320 pointing at each other while the support of the central holding element 110 and the umbrella strut element 120 against each other at their contact point is illustrated in the drawing by means of two pairs of arrows 325, 330 and 335, 340 pointing at each other. A respective contact point can also extend, for example, over an area between the two pairs of arrows 305, 310 and 315, 320; and 325, 330 and 335, 340 and on both sides, as shown in FIG. 3.

In addition to the support of the central holding element 110 and a respective umbrella strut element against each other, two adjoining umbrella strut elements can also be supported against each other at their respective contact point. A respective umbrella strut element and an umbrella strut element adjoining it on a first side are supported against each other at a contact point, which is located at an end of the umbrella strut element oriented toward an umbrella strut element adjoining it on the first side, while the umbrella strut element and an umbrella strut element adjoining it on a second side are supported against each other at a contact point, which is located at an end—oriented toward the umbrella strut element—of the umbrella strut element adjoining the second side. This is visible in FIG. 3 and FIG. 4 as well, for example for the umbrella strut element 120, the umbrella strut element 125 adjoining it on a first side, and the umbrella strut element 115 adjoining it on a second side.

The support of adjoining umbrella strut elements against one another is more pronounced the more umbrella strut elements the umbrella 100 has and the more powerful the forces are that act on the umbrella 100 from the outside. The support of two adjoining umbrella strut elements against each other is shown for the two umbrella strut elements 115, 120 in FIG. 3 by means of a pair of arrows 345, 350 pointing at each other.

As a result, in comparison to previously known inflatable umbrellas, the umbrella 100 according to the first exemplary embodiment has a greater stability when in the inflated state. This means that it is more resistant to external forces such as wind forces or forces generated by the impact of raindrops.

Figure 4:
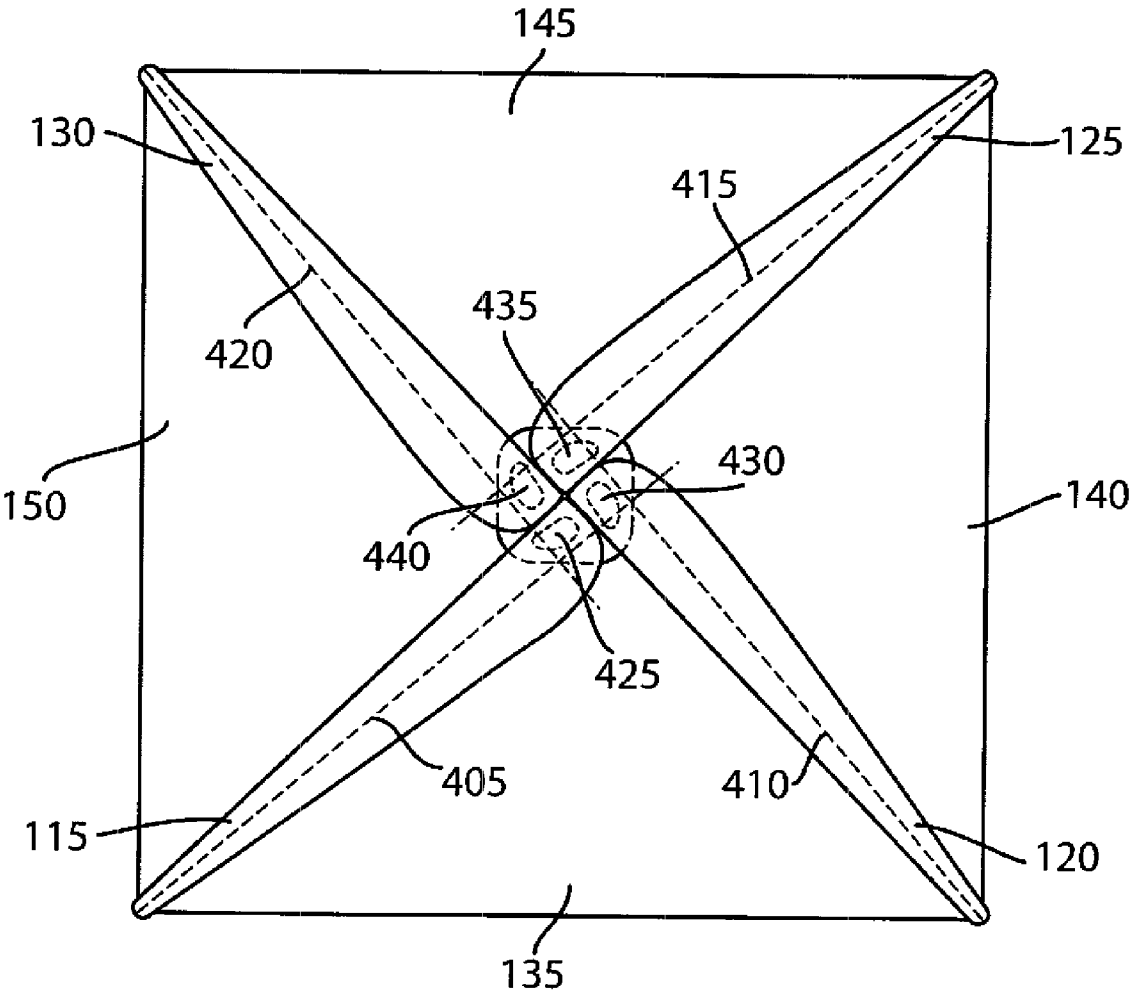
FIG. 4 is a top view of the umbrella according to the first exemplary embodiment in the inflated state.

FIG. 4 is a top view of the umbrella 100 according to the first exemplary embodiment in the inflated state. This top view shows imaginary center axes 405, 410, 415, 420 of the umbrella strut elements 115, 120, 125, 130 and the contact points or contact surfaces 425, 430, 435, 440 between the central holding element 110 and the umbrella strut elements 115, 120, 125, 130. It is clear that an imaginary center axis of an umbrella strut element, e.g. the imaginary center axis 405 of the umbrella strut element 115, intersects with an imaginary center axis of an umbrella strut element adjoining it on a first side, e.g. the imaginary center axis 410 of the umbrella strut element 120, outside of an imaginary center axis of the central holding element 110 (which in FIG. 4, extends in the middle of the cross-section of the central holding element 110 and perpendicular to the plane of the drawing, but is not explicitly depicted) and the imaginary center axis of the umbrella strut element and the imaginary center axis of the umbrella strut element adjoining it on the first side are askew to each other and a span of extremely short length between these two imaginary center axes does not intersect the imaginary center axis of the central holding element 110. As a result, ends of the umbrella strut elements 115, 120, 125, 130 oriented toward the central holding element 110 are grouped around the central holding element 110 in a way that centers, vertically aligns, and stabilizes this central holding element.

A cross-sectional area of the central holding element 110 increases in a penultimate section of the central holding element 110 before the umbrella strut elements 115, 120, 125, 130 and decreases in a final section of the central holding element 110 before the umbrella strut elements 115, 120, 125, 130. As a result, at an end of the central holding element 110 oriented toward the umbrella strut elements 115, 120, 125, 130, a number of oblique surfaces is formed, which corresponds to the number of umbrella strut elements. In the umbrella 100 according to the first exemplary embodiment, this number is four. A cross-sectional area of a respective umbrella strut element increases in a penultimate section of the umbrella strut element before the central holding element 110 and decreases in a final section of the umbrella strut element before the central holding element 110. As a result, at an end of the respective umbrella strut element oriented toward the central holding element 110, an oblique surface is produced, whose angle corresponds to an angle of the corresponding oblique surface of the central holding element 110. The angle here can vary, but must not be too flat in order to prevent the umbrella surface from folding inside out, for example, when acted on by wind forces. The central holding element 110 and the umbrella strut elements 115, 120, 125, 130 are supported against one another by means of the oblique surfaces that correspond to each other.

The embodiment of the associated ends of the central holding element 110 and umbrella strut elements 115, 120, 125, 130 can therefore also be described as follows. The end of the central holding element 110 oriented toward the umbrella strut elements 115, 120, 125, 130 is embodied as essentially pyramid-shaped and a cross-sectional area of the central holding element 110 constituting a base of the pyramid and a respective contact point of the central holding element 110 and a respective umbrella strut element, e.g. the contact point 425 of the central holding element 110 and the umbrella strut element 115, is situated on a respective side surface of the pyramid. The end of the respective umbrella strut element, i.e. the umbrella strut element 115, oriented toward the central holding element 110 is embodied as essentially pyramid-shaped; a cross-sectional area of the respective umbrella strut element constitutes a base of the pyramid; the respective contact point of the respective umbrella strut element and the central holding element, e.g. the contact point 425 of the umbrella strut element 115 and the central holding element 110, is situated on a first side surface of the pyramid; a respective contact point of the respective umbrella strut element and an umbrella strut element adjoining it on a first side, e.g. the umbrella strut element 120, is situated on a second side surface of the pyramid; and a contact point of the respective umbrella strut element and an umbrella strut element adjoining it on a second side, e.g. the umbrella strut element 130, is situated on a third side surface of the pyramid. In this case, angles of the corresponding side surfaces of the pyramid are not too flat and are selected so that they fit one another.

In other words, a reverse pyramid structure encloses the central holding element 110 concentrically so that this central holding element is centered, vertically aligned, and stabilized. This gives the umbrella 100 the required stability.

The rigidity of the central holding element 110 is greater in a region with a larger cross-sectional area. This is calculated based on the Kessel formula according to which tangential and axial stresses in the inflatable envelope 105 are greater in the region with the larger cross-sectional area, which results in a greater rigidity and stability of the central holding element 110 in this region. The same is true for each of the umbrella strut elements 115, 120, 125, 130 in a respective region with a larger cross-sectional area.

Figure 5:
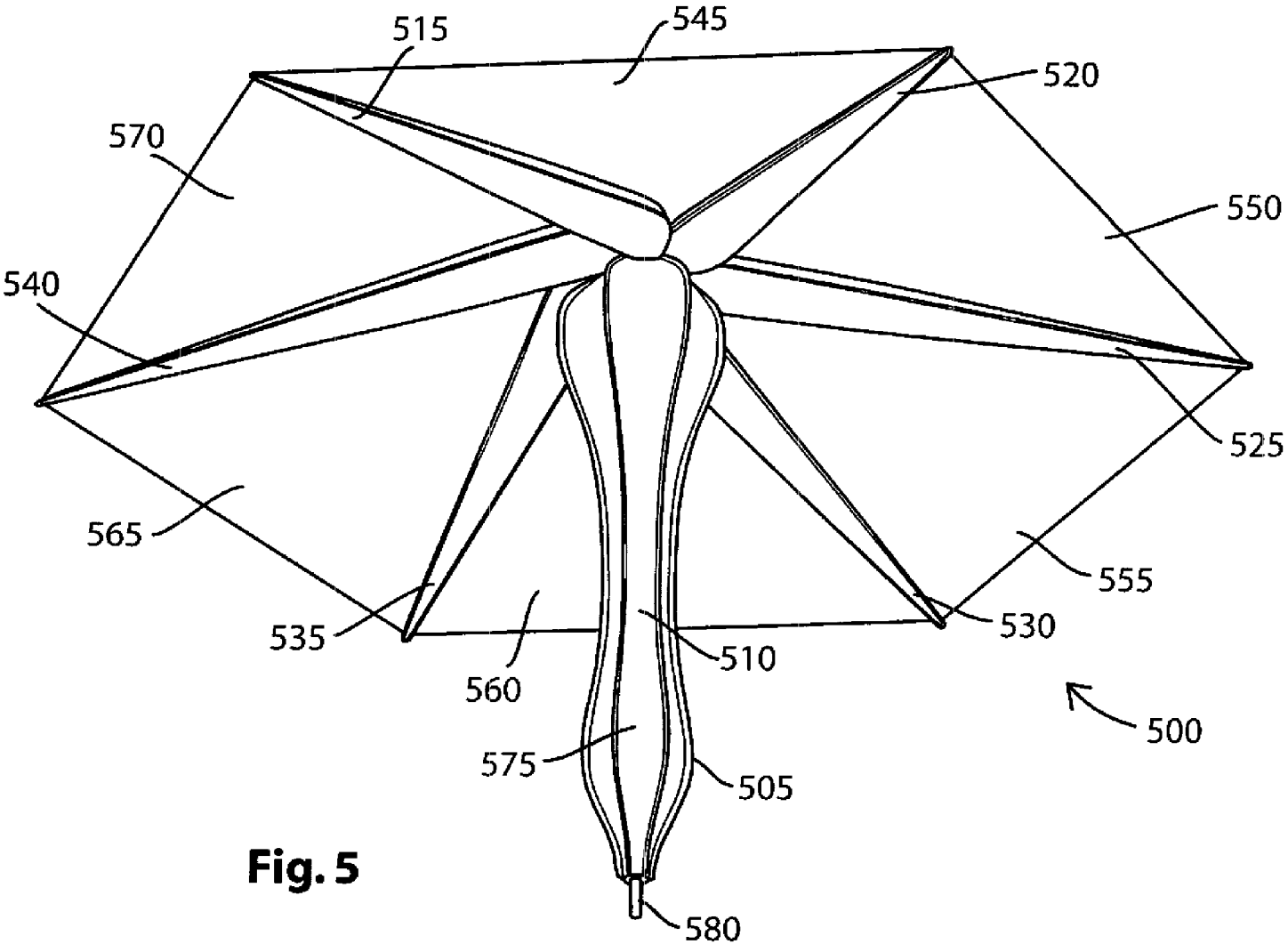
FIG. 5 is a perspective view (obliquely from below) of an umbrella according to a second exemplary embodiment in an inflated state.

FIG. 5 is a perspective view (obliquely from below) of an umbrella 500 according to a second exemplary embodiment in an inflated state. The umbrella 500 according to the second exemplary embodiment differs from the umbrella 100 according to the first exemplary embodiment in that it has two more umbrella strut elements, i.e. is provided with six umbrella strut elements.

In the umbrella 500 according to the second exemplary embodiment, an inflatable envelope 505 in the inflated state forms a central holding element 510, six umbrella strut elements 515, 520, 525, 530, 535, 540 extending away from the central holding element 510, and six umbrella surface elements 545, 550, 555, 560, 565, 570 spread open by the umbrella strut elements 515, 520, 525, 530, 535, 540. The central holding element 510 has a handle 575 whose lower end is provided with a first valve 580. The above explanations regarding the umbrella 100 according to the first exemplary embodiment also apply in analogous to the umbrella 500 according to the second exemplary embodiment.

Figure 6:
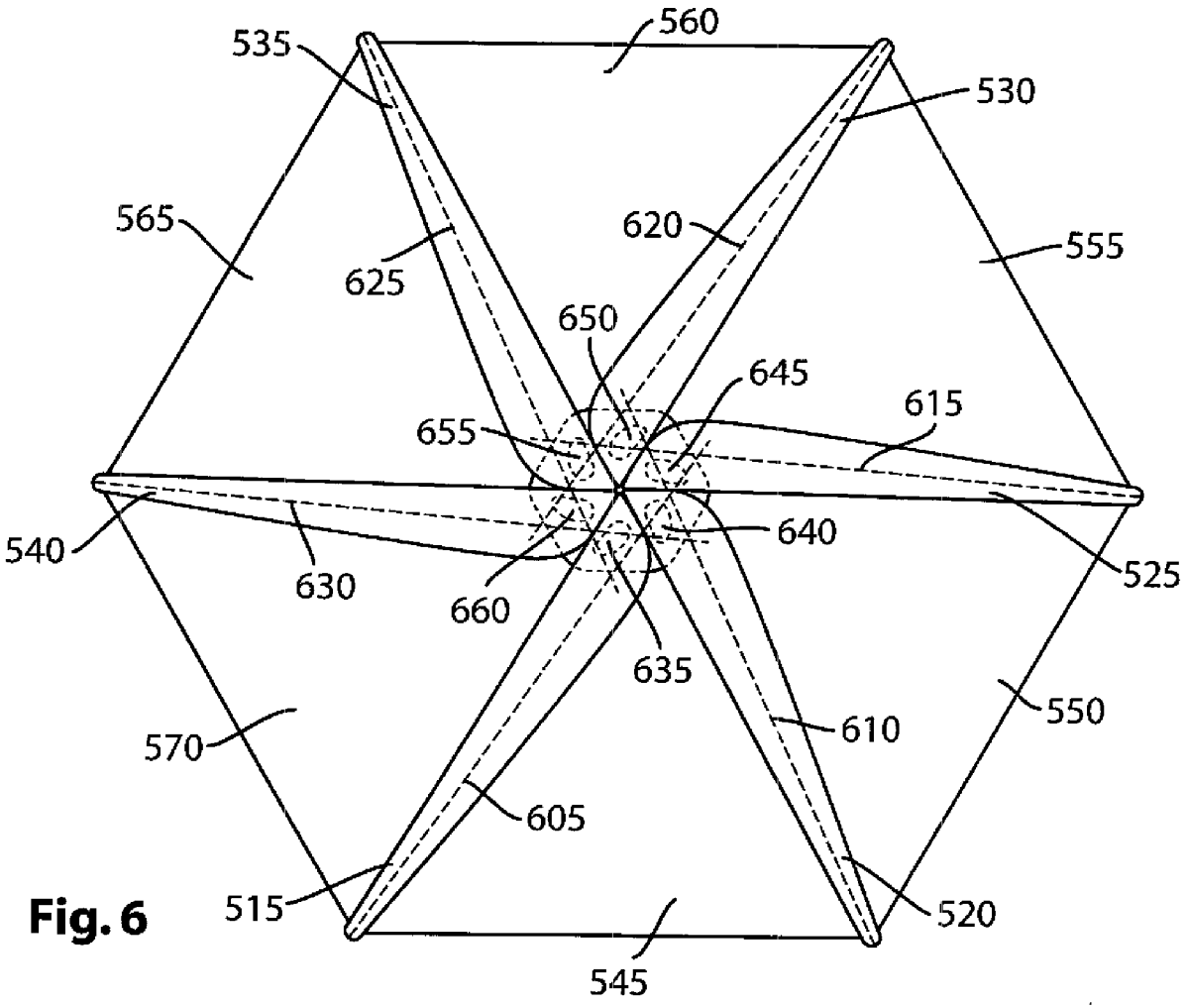
FIG. 6 is a top view of the umbrella according to the second exemplary embodiment in the inflated state.

FIG. 6 is a top view of the umbrella 500 according to the second exemplary embodiment in the inflated state. This top view shows imaginary center axes 605, 610, 615, 620, 625, 630 of the umbrella strut elements 515, 520, 525, 530, 535, 540 and contact points or contact surfaces 635, 640, 645, 650, 655, 660 between the central holding element 510 and the umbrella strut elements 515, 520, 525, 530, 535, 540.

The above sections describe umbrellas 100, 500 respectively provided with four and six umbrella strut elements according to the first and second exemplary embodiments. Naturally, it is also possible to produce umbrellas with more or fewer umbrella strut elements. In general, at least three umbrella strut elements are required in order for the umbrella to remain stable in the inflated state. When there are only three umbrella strut elements, there are therefore also only three umbrella surface elements and the umbrella is triangular when viewed from above. With a number of umbrella strut elements totaling 12 or more, on the one hand, a manufacture of the umbrella is in fact too complicated sometimes and on the other hand, the production is more complex and therefore expensive the more umbrella strut elements are provided. In principle, however, the number of umbrella strut elements is unlimited at the top end.

Figure 7:
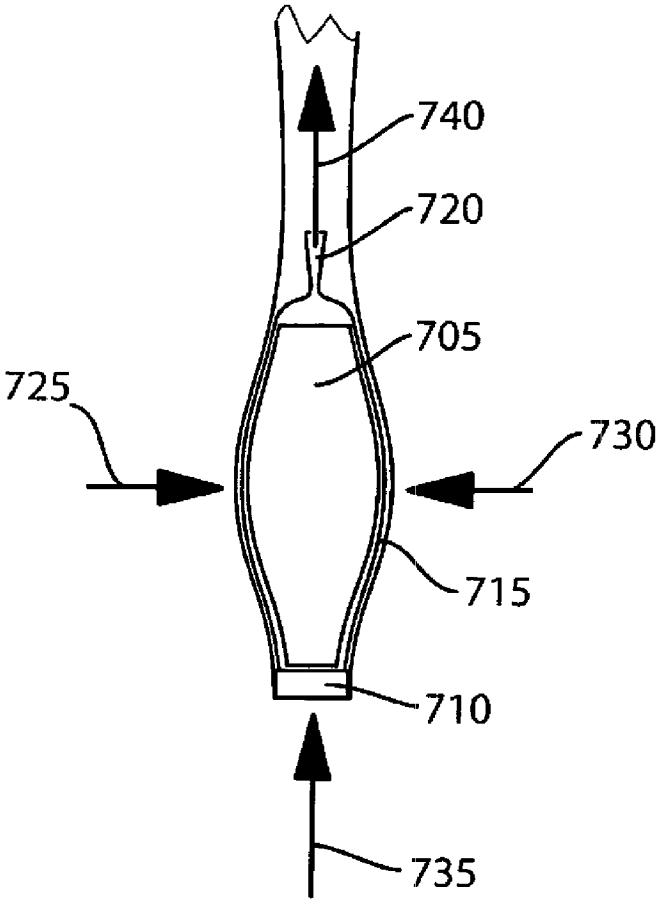
FIG. 7 is a cross-sectional view of a first alternative inflating system for the umbrella according to the first or second exemplary embodiment.

FIG. 7 is a cross-sectional view of a first alternative inflating system for the umbrella 100 or 500 according to the first or second exemplary embodiment. In this case, the central holding element 110 or 510 has a compressible material 705 and a valve 710 in a region before its end oriented away from its umbrella strut elements 115, 120, 125, 130 and 515, 520, 525, 530, 535, 540; the compressible material 705 and the valve 710 can also be provided at another location in the umbrella 100 or 500. If after being manufactured, the umbrella 100 or 500 is collapsed down under a negative pressure or vacuum, the volume of the compressible material 705 can be minimized, thus achieving a small size of the collapsed umbrella 100 or 500.

The compressible material 705 can be enclosed by an envelope 715 of flexible material whose lower end is connected to a valve 710 and whose upper end constitutes an inner tube valve 720 that can be controlled by a pressure on the interior of the inflatable envelope 105 or 505. The valve 710 can be a check valve, e.g. a diaphragm valve, which can be composed of a soft diaphragm and a device that holds the diaphragm. Instead of the inner tube valve 720, a different type of valve can also be provided at the upper end of the envelope 715. For example, a diaphragm valve can be used here as well.

By compressing the compressible material 705, a gaseous substance for the inflation of the inflatable envelope 105 or 505 can be aspirated via the valve 710 and conveyed into the interior of the inflatable envelope 105 or 505 via the inner tube valve 720. The gaseous substance is typically ambient air. Incoming air is conveyed through the valve 710 and checked by it. This process is indicated in FIG. 7 by two arrows 725, 730 that symbolize the compression and two arrows 735, 740 that symbolize the aspiration and the conveying of the air into the interior of the inflatable envelope 105 or 505 via the inner tube valve 720.

The compressible material 705 can be a material with a foam structure. For example, it can be normal foam. When a pressure in the inflatable envelope 105 or 505 increases, this increasing pressure gradually compresses the compressible material 705 further and further. This successive compression of the material due to the increasing pressure inside the inflatable envelope 105 or 505 gradually reduces a pumping power that can be achieved with the compressible material 705, thus making it impossible for excessive pressure to be built up in the inflatable envelope 105 or 505. In other words, the internal pressure in the inflatable envelope 105 or 505 building up during the pumping-up procedure achieves a desired reduction in the pumping power, which automatically prevents a maximum permissible pressure from being exceeded.

The compressible material 705 can be situated in the handle 155 or 575 of the central holding element 110 or 510 and can be compressed through manual pumping actions executed by a user. This enables optimal use to be made of the shape of the hollow of a hand. The user can therefore first pump up the umbrella 100 or 500 by repeatedly compressing the handle 155 or 575 and after it is inflated, can hold the umbrella 100 or 500 by the handle 155 or 575. In this connection, for both the pumping-up and for the subsequent holding, it is advantageous if the handle 155 or 575 is ergonomically shaped and fits well into the user's hand.

Figure 8:
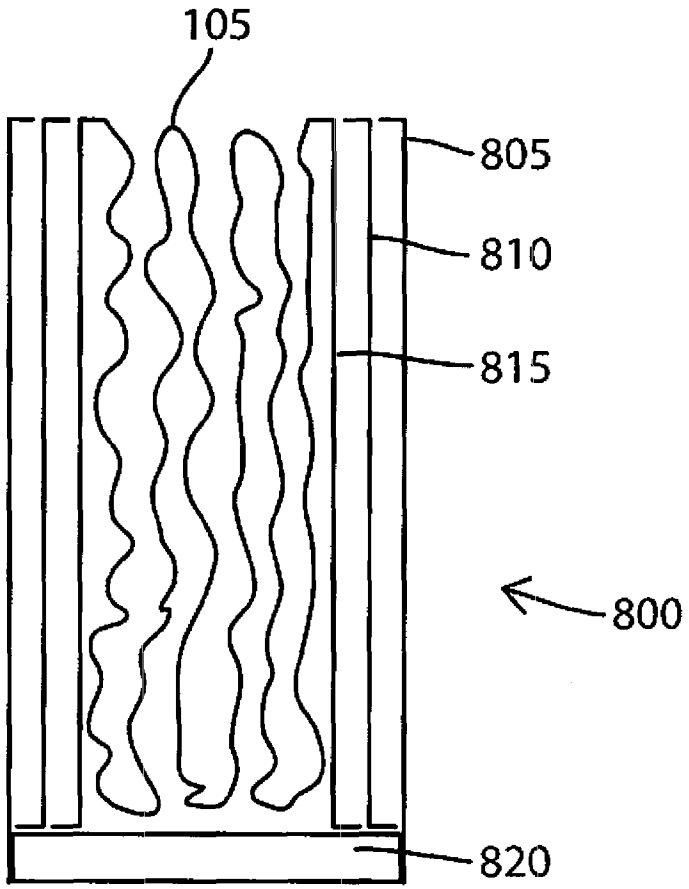
FIG. 8 is a cross-sectional view of a second alternative inflating system for the umbrella according to the first or second exemplary embodiment.

FIG. 8 is a cross-sectional view of a second alternative inflating system for the umbrella 100 or 500 according to the first or second exemplary embodiment. In this case, the umbrella 100 or 500 has a telescoping handle 800 with at least two segments. In the exemplary embodiment of the telescoping handle 800, which is shown in FIG. 8, there are three segments 805, 810, 815. The telescoping handle 800 is provided with a valve 820 at its lower end.

By pumping actions of the telescoping handle 800, a gaseous substance for inflating the inflatable envelope 105 or 505 can be aspirated via the valve 820 and conveyed to the interior of the inflatable envelope 105 or 505. Before the inflation process, the inflatable envelope 105 or 505 is contained inside the telescoping handle 800.

Figure 9:
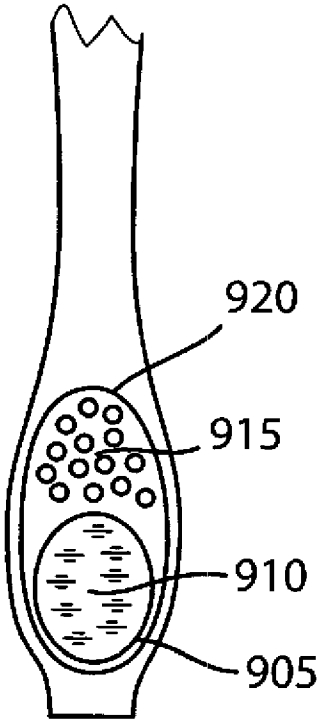
FIG. 9 is a cross-sectional view of a third alternative inflating system for the umbrella according to the first or second exemplary embodiment.

FIG. 9 is a cross-sectional view of a third alternative inflating system for the umbrella 100 or 500 according to the first or second exemplary embodiment. In this case, at least two chemical substances are situated separately from each other in the inflatable envelope 105 or 505, which produce a chemical reaction when brought into contact with each other. This chemical reaction generates a gaseous substance for inflating the inflatable envelope 105 or 505. The gaseous substance disperses inside the inflatable envelope 105 or 505, thus inflating the umbrella 100 or 500.

As is clear from FIG. 9, a first chemical substance 910 is provided in a container 905 such as a pouch composed of a flexible material. The first chemical substance 910 can contain or be composed of a liquid. The liquid can, for example, be an acid such as citric acid, formic acid, tartaric acid, malic acid, succinic acid, amido-sulfuric acid, or fumaric acid. A second chemical substance 915 is situated next to the container 905. The second chemical substance 915 can contain or be composed of a solid; the solid can be embodied in the form of a powder or granulate. For example, the solid can be a sodium carbonate (soda) or bicarbonate of soda (baking soda).

Pressing in on the inflatable envelope 105 or 505 at a corresponding location can compress the container 905 in such a way that it bursts. As a result, the first chemical substance 910 can escape and come into contact with the second chemical substance 915. The contact of the two chemical substances can trigger a chemical reaction that generates a gaseous substance for the inflation. For example, the chemical reaction can generate gaseous carbon dioxide.

The container 905 and the second chemical substance 915 can be enclosed by a membrane 920. The membrane 920 ensures that after the container 905 bursts, the first chemical substance 910 comes into contact as precisely and as completely as possible with the second chemical substance 915. It prevents the first chemical substance 910 or the second chemical substance 915 from escaping into the interior of the inflatable envelope 105 or 505 outside the membrane 920 and permits the gaseous substance generated by the chemical reaction to pass through.

Other systems that are not described in detail here can also be used in addition to the inflating systems described above. These can, for example, include only a cartridge or capsule that contains a gaseous substance for inflation. Possible gaseous substances for this purpose include, for example, carbon dioxide, nitrous oxide, nitrogen, or compressed air.

The above sections describe examples of an umbrella in which a number of umbrella surface elements corresponds to a number of umbrella strut elements. It is also possible, however, to produce an umbrella with a smaller number of umbrella strut elements. For example, only a single umbrella surface element can be provided, which is spread open by all of the umbrella strut elements together, with each pair of adjoining umbrella strut elements spreading open an edge of the umbrella surface element situated between them.

In the umbrellas described above, the central holding element has an ergonomically shaped handle with a changed cross-sectional area in a region before an end of the central holding element oriented away from the umbrella strut elements. A handle of this kind, however, is not required. An umbrella can also be produced with a central holding element whose cross-section is constant in a region before an end of the central holding element oriented away from the umbrella strut elements.

In conclusion, the present invention relates to an inflatable umbrella 100 or 500. The umbrella 100 or 500 has an inflatable envelope 105 or 505 composed of a flexible material. In an inflated state, this envelope forms at least the following elements: a central holding element 110 or 510; at least three umbrella strut elements 115, 120, 125, 130 or 515, 520, 525, 530, 535, 540 extending away from the central holding element; and at least one umbrella surface element 135, 140, 145, 150 or 545, 550, 555, 560, 565, 570 stretched open by the umbrella strut elements. In this instance, the central holding element 110 or 510 and a respective umbrella strut element are supported against each other at their respective contact point 425, 430, 435, 440 or 635, 640, 645, 650, 655, 660. In comparison to previously known inflatable umbrellas, the umbrella 100 or 500 has a greater stability and resistance to external forces when in the inflated state.

The invention claimed is:

1. An inflatable umbrella with an inflatable envelope made of a flexible material, which in an inflated state comprises:

a central holding, element;

at least three umbrella strut elements extending away from the central holding element; and at least one umbrella surface element stretched open by the umbrella strut elements, wherein the envelope of the central holding element and each umbrella strut element have contact surfaces, and the central holding element and each umbrella strut element are supported against each other at their respective contact surfaces at an end of the central holding element oriented toward the umbrella strut elements, thereby functioning as a pressure element and a counter-pressure element.

2. The umbrella as recited in claim 1, wherein two respective adjoining umbrella strut elements are supported against each other at their respective contact surfaces.

3. The umbrella as recited in claim 1, wherein an imaginary center axis of a first umbrella strut element intersects with an imaginary center axis of a second umbrella strut element adjoining the first umbrella strut element on a first side of the first umbrella strut element, outside of an imaginary center axis of the central holding element.

4. The umbrella as recited in claim 1, wherein an imaginary center axis of a first umbrella strut element and an imaginary center axis of a second umbrella strut element adjoining the first umbrella strut element adjacent to the first umbrella strut element, are askew to each other, and a span of shortest length between the imaginary center axis of the first umbrella strut element along the length of the first umbrella strut element and the imaginary center axis of the second umbrella strut element along the length of the second umbrella strut element does not intersect with an imaginary center axis of the central holding element.

5. The umbrella as recited in claim 1, wherein a first umbrella strut element and a second umbrella strut element adjoining the first umbrella strut element on a first side of the first umbrella strut element, are supported against each other at a contact surface, which is located at an end of the first umbrella strut element oriented toward the second umbrella strut element on the first side of the first umbrella strut element, while the first umbrella strut element and a third umbrella strut element adjoining the first umbrella strut element on a second side of the first umbrella strut element are supported against each other at a contact surface, which is located at an end of the third umbrella strut element adjoining the second side oriented toward the first umbrella strut element.

6. The umbrella as recited in claim 1, wherein a cross-sectional area of the central holding element increases in a penultimate section of the central holding element before the umbrella strut elements and decreases in a final section of the central holding element before the umbrella strut elements and a cross-sectional area of each respective umbrella stint element increases in a penultimate section of the respective umbrella strut element before the central holding element and decreases in a final section of the umbrella strut element before the central holding element.

7. The umbrella as recited in claim 1, wherein an end of the central holding element oriented toward the umbrella strut elements is substantially pyramid-shaped, a cross-sectional area of the central holding element forms a base of a pyramid, and a respective contact surface of the central holding element and a respective umbrella strut element is situated on a respective side surface of the pyramid.

8. The umbrella as recited in claim 1, wherein an end of each respective umbrella strut element oriented toward the central holding element is substantially pyramid-shaped, a cross-sectional area of each respective umbrella strut element forms a base of a pyramid, a respective contact surface of the respective umbrella strut element and the central holding element is situated on a first side surface of the pyramid, a contact surface of the respective umbrella strut element and an umbrella strut element adjoining it on a first side is situated on a second side surface of the pyramid, and a contact surface of the respective umbrella strut element and an umbrella strut element adjoining it on a second side is situated on a third side surface of the pyramid.

9. The umbrella as recited in claim 1, wherein the umbrella comprises a compressible material and a valve and through compression of the compressible material, a gaseous substance for inflation can be aspirated via the valve and conveyed into an interior of the inflatable envelope.

10. The umbrella as recited in claim 9, wherein the compressible material is enclosed by an envelope composed of a flexible material whose one end is connected to the valve and whose other end forms an inner tube valve, wherein the gaseous substance can be conveyed into the interior of the inflatable envelope via the inner tube valve.

11. The umbrella as recited in claim 9, wherein the compressible material is a material with a foam structure that can be successively compressed by an increasing pressure in the inflatable envelope so that a pumping power that can be achieved with the compressible material decreases and excessive pressure does not build up in the inflatable envelope.

12. The umbrella as recited in claim 9, wherein the compressible material is situated in a handle of the central holding element with a changed cross-sectional area and can be compressed through manual pumping actions executed by a user.

13. The umbrella as recited in claim 1, wherein at least two chemical substances are situated separately from each other in the inflatable envelope; when the at least two chemical substances are brought into contact with each other, a chemical reaction is triggered, generating a gaseous substance that inflates the inflatable envelope.

14. The umbrella as recited in claim 1, wherein the umbrella has a telescoping handle and before an inflation, the inflatable envelope is contained inside the telescoping handle.

15. The umbrella as recited in claim 1, wherein the inflatable envelope has at least one valve and can be inflated and/or deflated via the valve.

* * * * *